US009664082B2

(12) United States Patent
Yi et al.

(10) Patent No.: US 9,664,082 B2
(45) Date of Patent: May 30, 2017

(54) REDUCTANT DOSING SYSTEM HAVING STAGGERED INJECTORS

(71) Applicant: Caterpillar Inc., Peoria, IL (US)

(72) Inventors: Yong Yi, Dunlap, IL (US); Jay Venkataraghavan, Dunlap, IL (US); Arvind Jujare, Peoria, IL (US); Steven Ray Lewis, Peoria, IL (US); Muheng Zhang, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 247 days.

(21) Appl. No.: 14/293,614

(22) Filed: Jun. 2, 2014

(65) Prior Publication Data

US 2015/0345356 A1 Dec. 3, 2015

(51) Int. Cl.

| | |
|---|---|
| ***F01N 3/28*** | (2006.01) |
| ***F01N 3/20*** | (2006.01) |
| ***B01F 3/04*** | (2006.01) |
| ***B01F 5/04*** | (2006.01) |
| ***B01F 15/02*** | (2006.01) |

(Continued)

(52) U.S. Cl.

CPC ..... *F01N 3/2073* (2013.01); *B01F 3/04014* (2013.01); *B01F 3/04049* (2013.01); *B01F 3/04078* (2013.01); *B01F 5/0268* (2013.01); *B01F 5/04* (2013.01); *B01F 5/0473* (2013.01); *B01F 5/0485* (2013.01); *B01F 5/0619* (2013.01); *B01F 15/0254* (2013.01)

(58) Field of Classification Search

CPC ..... F01N 3/2892
USPC ..... 366/337
See application file for complete search history.

(56) References Cited

U.S. PATENT DOCUMENTS 3,716,344 A * 2/1973 Ashburn ..... B01D 53/9454 422/173
4,981,368 A * 1/1991 Smith ..... B01F 5/0473 366/337

(Continued)

FOREIGN PATENT DOCUMENTS

DE 102006055655 5/2008
DE 102008029809 12/2009

(Continued)

OTHER PUBLICATIONS

U.S. Appl. No. 13/856,138, filed Apr. 3, 2013 entitled "Mixer for Fluid Injection System".

(Continued)

*Primary Examiner* — Tony G Soohoo
*Assistant Examiner* — Elizabeth Insler
(74) *Attorney, Agent, or Firm* — Finnegan, Henderson, Farabow, Garrett & Dunner, LLP

(57) ABSTRACT

A mixer is disclosed for use in a reductant dosing system. The mixer may have an impingement floor located within an intended fluid injection path and generally parallel with a flow direction through the mixer. The mixer may also have a first side wall connected along a lengthwise edge of the impingement floor, a second side wall connected along an opposing lengthwise edge of the impingement floor, and a plurality of shelves extending between the first and second side walls. The plurality of shelves each may include a plurality of vanes that promote mixing of an injected fluid. One or more of the plurality of shelves may extend different distances upstream opposite the flow direction.

7 Claims, 4 Drawing Sheets

(51) Int. Cl.
*B01F 5/02* (2006.01)
*B01F 5/06* (2006.01)

(56) References Cited

U.S. PATENT DOCUMENTS

| | | | |
|---|---|---|---|
| 5,988,115 | A | 11/1999 | Anderson et al. |
| 6,601,385 | B2 | 8/2003 | Verdegan et al. |
| 6,722,123 | B2 | 4/2004 | Liu et al. |
| 7,328,572 | B2 | 2/2008 | McKinley et al. |
| 7,467,749 | B2 | 12/2008 | Tarabulski et al. |
| 8,017,084 | B1 | 9/2011 | Wirt et al. |
| 8,033,531 | B2 | 10/2011 | Beckmann et al. |
| 8,061,890 | B2 | 11/2011 | Suhner |
| 8,141,353 | B2 | 3/2012 | Zheng et al. |
| 8,240,135 | B2 | 8/2012 | Zhang |
| 8,250,859 | B2 | 8/2012 | Torisaka et al. |
| 8,297,050 | B2 | 10/2012 | Ranganathan et al. |
| 8,359,832 | B2 | 1/2013 | Yi et al. |
| 8,615,984 | B2 | 12/2013 | Kornherr et al. |
| 2002/0162322 | A1 | 11/2002 | Ganzmann et al. |
| 2011/0113764 | A1 | 5/2011 | Salanta et al. |
| 2012/0151902 | A1 | 6/2012 | Yi et al. |
| 2012/0189521 | A1 | 7/2012 | Shijo et al. |
| 2013/0104531 | A1 | 5/2013 | Cho et al. |
| 2013/0152555 | A1 | 6/2013 | Bui et al. |
| 2013/0188444 | A1 | 7/2013 | Palmer et al. |
| 2013/0269325 | A1 | 10/2013 | Hadden et al. |
| 2015/0040547 | A1* | 2/2015 | Brockman ..... F01N 3/2892 60/324 |

FOREIGN PATENT DOCUMENTS

| | | |
|---|---|---|
| DE | 102012208034 | 11/2013 |
| DE | 102012209087 | 12/2013 |
| WO | WO 2010057508 | 5/2010 |
| WO | WO 2012/164748 | 12/2012 |

OTHER PUBLICATIONS http://www.tenneco.com/original_equipment/emission_control/products_and_technologies, © Copyright 2011, Tenneco Inc. (printed on Mar. 27, 2013).

http://www.gillet.com/en/scr_technology (printed on Mar. 27, 2013).

* cited by examiner

REDUCTANT DOSING SYSTEM HAVING STAGGERED INJECTORS

TECHNICAL FIELD

The present disclosure relates generally to a reductant dosing system and, more particularly, to a reductant dosing system having staggered injectors.

BACKGROUND

Internal combustion engines, including diesel engines, gasoline engines, gaseous fuel-powered engines, and other engines known in the art exhaust a complex mixture of air pollutants. These air pollutants can include, among other things, gaseous compounds such as the oxides of nitrogen ($NO_X$). Due to increased awareness of the environment, exhaust emission standards have become more stringent, and the amount of $NO_X$ emitted from an engine may be regulated depending on the type of engine, size of engine, and/or class of engine. In order to ensure compliance with the regulation of these compounds, some engine manufacturers have implemented a process called Selective Catalytic Reduction (SCR).

SCR is a process where a reductant (most commonly a urea/water solution) is injected into the exhaust gas stream of an engine and adsorbed onto a catalyst. The reductant reacts with $NO_X$ in the exhaust gas to form water ($H_2O$) and elemental nitrogen ($N_2$). Although SCR can be effective, when the reductant is sprayed onto relatively cool walls of the exhaust system it can condense. This condensation can create deposits that foul the injectors and cause premature wear and failure of the injection system. In addition, the condensed reductant may no longer be useful in reducing regulated emissions.

An exemplary dosing system is disclosed in U.S. Patent Publication No. 2013/0104531 of Cho et al. that published on May 2, 2013 ("the '531 publication"). Specifically, the '531 publication describes a system having an exhaust manifold, an SCR, and a static mixer connected between the exhaust manifold and the SCR. The static mixer includes an external tube, an internal tube, and a channel unit. The external tube is connected to the exhaust manifold by welding. The internal tube is disposed within the external tube and spaced apart therefrom by a constant gap. The channel unit is provided inside the internal tube, and includes multiple guiding channels in a longitudinal direction and an inlet portion facing a tilted urea injector adapter. The guiding channels have horizontal channel plates that are spaced apart at predetermined intervals and include through-holes that promote mixing. A plurality of blades are provided at an end point of the channel plates, and the blades are angled in opposing directions for each layer of plates. The inlet of the channel unit is inclined relative to an axis of the internal tube.

While the system of the '531 publication may reduce condensation through the use of the spaced apart walls and improve mixing via the through-holes and blades, the system may still be less than optimal. Specifically, because the system receives urea at a single location (i.e., at only the urea injector adapter), the injection of urea may be too concentrated or focused for efficient droplet dispersion within the exhaust stream. In addition, the geometry of the channel plates may be insufficient to adequately mix the injected urea with the exhaust.

The present disclosure is directed at overcoming one or more of the shortcomings set forth above and/or other problems of the prior art.

SUMMARY

In one aspect, the present disclosure is directed to mixer. The mixer may include an impingement floor located within an intended fluid injection path and generally parallel with a flow direction through the mixer. The mixer may also include a first side wall connected along a lengthwise edge of the impingement floor, a second side wall connected along an opposing lengthwise edge of the impingement floor, and a plurality of shelves extending between the first and second side walls. The plurality of shelves each may have a plurality of vanes that promote mixing of an injected fluid. One or more of the plurality of shelves may extend different distances upstream opposite the flow direction.

In another aspect, the present disclosure is directed to a dosing system. The dosing system may include an exhaust passage, and a mixer disposed within the exhaust passage. The dosing system may also include at least a first reductant injector disposed within the exhaust passage upstream of the mixer at a first axial location, and at least a second reductant injector disposed within the exhaust passage upstream of the mixer at a second axial location different than the first axial location.

In yet another aspect, the present disclosure is directed to a method of dosing reductant. The method may include injecting reductant into an exhaust flow from a first location upstream of a mixer, and injecting reductant into the exhaust flow from a second location upstream of the mixer. The method may also include directing injected reductant and exhaust through a central flow path of the mixer, and directing exhaust from peripheral flow paths around the mixer toward the central flow path.

DETAILED DESCRIPTION

Figure 1:
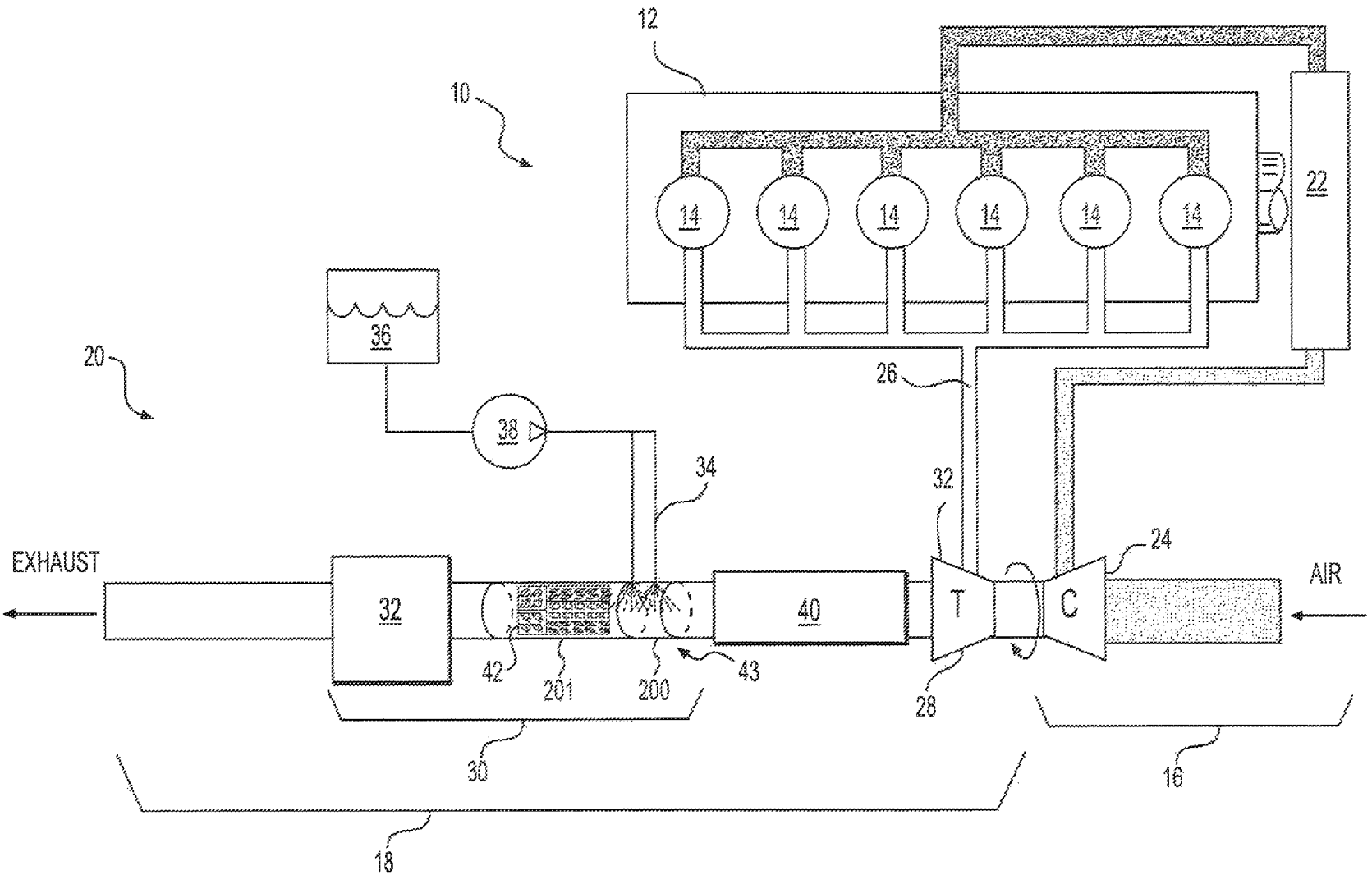
FIG. 1 is a diagrammatic illustration of an engine having an exemplary dosing system.

FIG. 1 illustrates an exemplary engine 10. For the purposes of this disclosure, engine 10 is depicted and described as a diesel-fueled, internal combustion engine. However, it is contemplated that engine 10 may embody any other type of combustion engine such as, for example, a gasoline engine or a gaseous fuel-powered engine burning compressed or liquefied nature gas, propane, or methane. Engine 10 may include an engine block 12 at least partially defining a plurality of cylinders 14, and a plurality of piston assemblies (not shown) disposed within cylinders 14 to form a plurality of combustion chambers (not shown). It is contemplated that engine 10 may include any number of combustion chambers and that the combustion chambers may be disposed in an in-line configuration, in a "V" configuration, in an opposing-piston configuration, or in any other conventional configuration.

Multiple separate sub-systems may be associated within engine 10 and cooperate to facilitate the production of power. For example, engine 10 may include an air induction system 16, an exhaust system 18, and a dosing system 20. Air induction system 16 may be configured to direct air or an air and fuel mixture into engine 10 for subsequent combustion. Exhaust system 18 may exhaust byproducts of combustion to the atmosphere. Dosing system 20 may function to reduce the discharge of regulated constituents by engine 10 to the atmosphere.

Air induction system 16 may include multiple components configured to condition and introduce compressed air into cylinders 14. For example, air induction system 16 may include an air cooler 22 located downstream of one or more compressors 24. Compressors 24 may be connected to pressurize inlet air directed through cooler 22. It is contemplated that air induction system 16 may include different or additional components than described above such as, for example, a throttle valve, variable valve actuators associated with each cylinder 14, filtering components, compressor bypass components, and other known components that may be selectively controlled to affect an air-to-fuel ratio of engine 10, if desired. It is further contemplated that compressor 24 and/or cooler 22 may be omitted, if a naturally aspirated engine is desired.

Exhaust system 18 may include multiple components that condition and direct exhaust from cylinders 14 to the atmosphere. For example, exhaust system 18 may include an exhaust passage 26 and one or more turbines 28 driven by exhaust flowing through passage 26. It is contemplated that exhaust system 18 may include different or additional components than described above such as, for example, bypass components, an exhaust compression or restriction brake, an attenuation device, and other known components, if desired.

Turbine 28 may be located to receive exhaust leaving engine 10, and may be connected to one or more compressors 24 of air induction system 16 by way of a common shaft to form a turbocharger. As the hot exhaust gases exiting engine 10 move through turbine 28 and expand against vanes (not shown) thereof, turbine 28 may rotate and drive the connected compressor 24 to pressurize inlet air.

Dosing system 20 may include components configured to trap, catalyze, reduce, or otherwise remove regulated constituents from the exhaust flow of engine 10 prior to discharge to the atmosphere. For example, dosing system 20 may include a reduction device 30 fluidly connected downstream of turbine 28.

Reduction device 30 may receive exhaust from turbine 28 and reduce particular constituents of the exhaust. In one example, reduction device 30 is a Selective Catalytic Reduction (SCR) device having one or more serially-arranged catalyst substrates 32 located downstream from one or more reductant injectors 34. A gaseous or liquid reductant, most commonly urea ($(NH_2)_2CO$), a water/urea mixture, a hydrocarbon such as diesel fuel, or ammonia gas ($NH_3$), may be sprayed or otherwise advanced into the exhaust within passage 26 at a location upstream of catalyst substrate(s) 32 by reductant injector(s) 34. This process of injecting reductant upstream of catalyst substrate 32 is known as dosing. To facilitate dosing of catalyst substrate(s) 32 by reductant injector 34, an onboard supply 36 of reductant and a pressurizing device 38 may be associated with reductant injector 34. The reductant sprayed into passage 26 may flow downstream with the exhaust from engine 10 and be adsorbed onto the surface of catalyst substrate(s) 32, where the reductant may react with $NO_X$ (NO and $NO_2$) in the exhaust gas to form water ($H_2O$) and elemental nitrogen ($N_2$). This process performed by reduction device 30 may be most effective when a concentration of NO to $NO_2$ supplied to reduction device 30 is about 1:1.

To help provide the correct concentration of NO to $NO_2$, an oxidation catalyst 40 may be located upstream of reduction device 30, in some embodiments. Oxidation catalyst 40 may be, for example, a diesel oxidation catalyst (DOC). As a DOC, oxidation catalyst 40 may include a porous ceramic honeycomb structure or a metal mesh substrate coated with a material, for example a precious metal, which catalyzes a chemical reaction to alter the composition of the exhaust. For instance, oxidation catalyst 40 may include a washcoat of palladium, platinum, vanadium, or a mixture thereof that facilitates the conversion of NO to $NO_2$.

In one embodiment, oxidation catalyst 40 may also perform particulate trapping functions. That is, oxidation catalyst 40 may be a catalyzed particulate trap such as a continuously regenerating particulate trap or a catalyzed continuously regenerating particulate trap. As a particulate trap, oxidation catalyst 40 may function to trap or collect particulate matter.

In order for reductant injected into exhaust passage 26 to be most effective at catalyzing $NO_X$, the reductant should be thoroughly mixed with the exhaust gas before reaching catalyst substrate(s) 32. When this is accomplished, the reductant is evenly spread across a face of each catalyst substrate 32 and all exhaust passing through catalyst substrate(s) 32 comes into contact with the injected reductant. For this purpose, a mixer 42 may be disposed within exhaust passage 26, at the location downstream of reductant injectors 34 and upstream of catalyst substrate(s) 32.

FIG. 1 shows exhaust passage 26 being divided into multiple segments, including at least a first segment 200 that houses injectors 34 and at least a second segment 201 that houses mixer 42. It is contemplated, however, that a greater or lesser number of segments may be used to form passage 26, if desired. For example, exhaust passage 26 could be an integral passage having a single segment. Alternatively, exhaust passage 26 could include one segment that houses injectors 34 and mixer 42 together, and other segments that connect to opposing ends of the one segment. Other configurations may also be possible.

Figure 2:
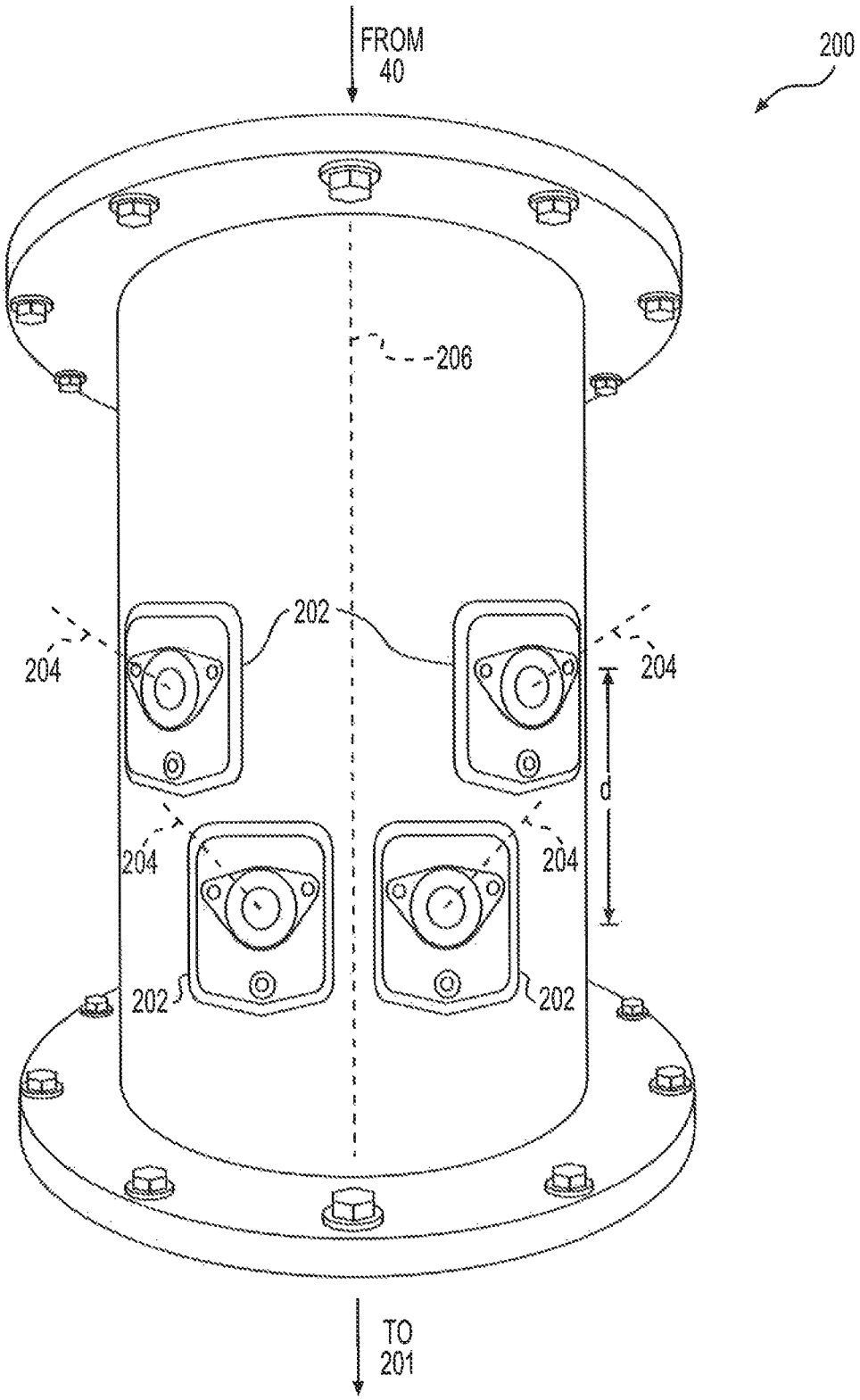
FIG. 2 is an isometric illustration of an exemplary disclosed exhaust passage that may be used with the dosing system of FIG. 1.

FIG. 2 illustrates an exemplary embodiment of exhaust passage segment 200. In this embodiment, segment 200 includes four injector adapters 202, each configured to receive a separate injector 34 (referring to FIG. 1). Adapters 202 may be staggered, such that reductant is injected at two or more axial locations within exhaust passage 26. Specifically, adapters 202 may be spaced apart by an axial distance d selected to provide a desired amount of reductant dispersion within exhaust passage 26 (i.e., to inhibit spray interaction leading to reductant coalescing). In one example, distance d may be about equal to ⅓-⅕ of a diameter of segment 200. Although adapters 202 are shown as being arranged in pairs, it is contemplated that adapters 202 may each be placed at a different axial location or that more than two adapters may be placed at the same axial location, as desired.

Figure 3:
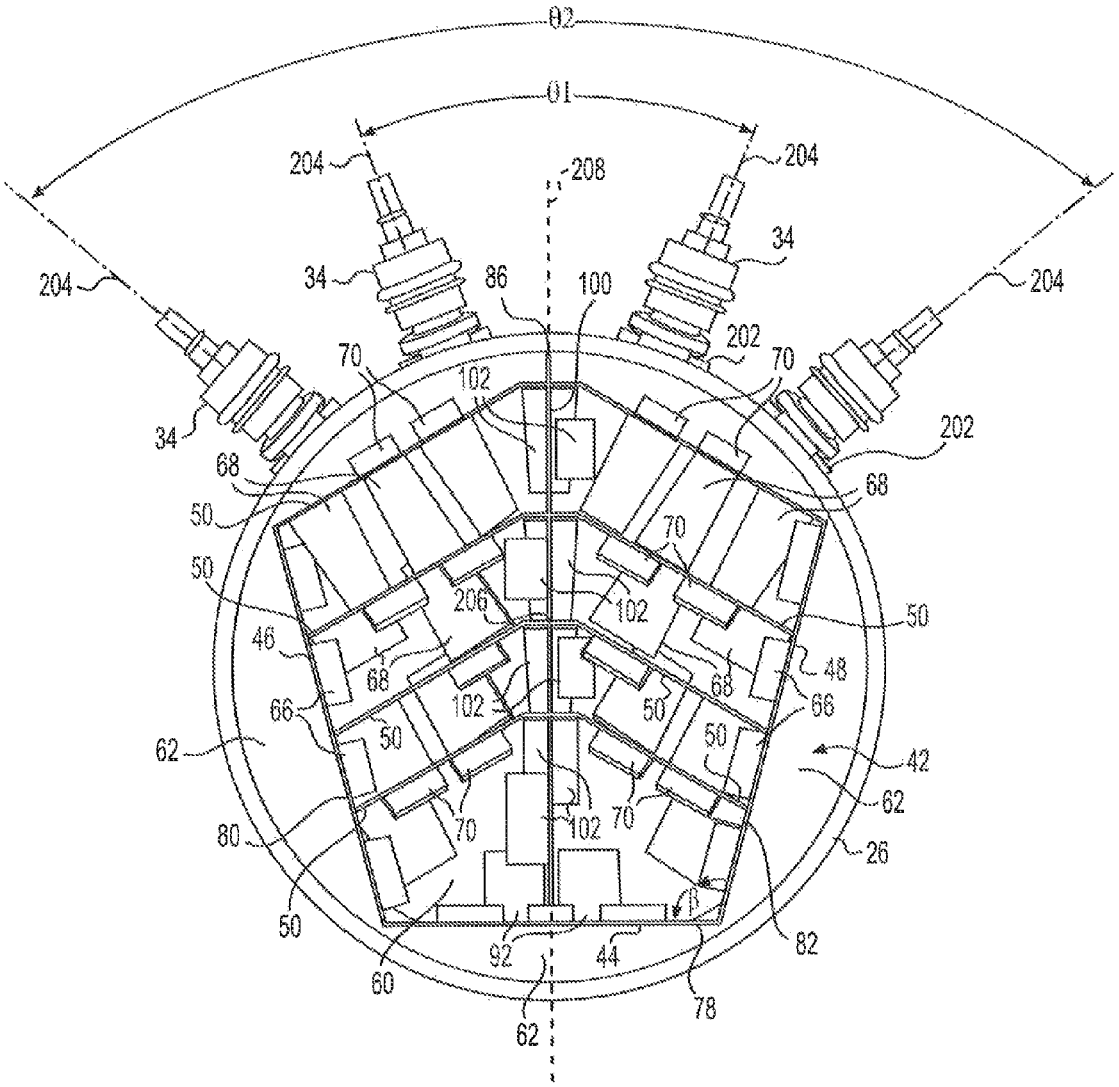
FIG. 3 a cross-sectional illustration of an exemplary disclosed mixer that may be used with the dosing system of FIG. 1.

In addition to being axially staggered, adapters 202 may also be located at different annular locations around the periphery of segment 200. For example, as shown in FIG. 3, two adapters 202 may be spaced apart by an angle $\theta_1$ (measured through an axis 204 of each adapter 202 and through a central axis 206 of exhaust passage 26) and symmetrically placed to either side of a plane of symmetry 208 that passes through mixer 42; and two adapters 202 may be spaced apart by an angle $\theta_2$ and symmetrically placed to either side of plane 208. In the disclosed example, the adapters 202 spaced apart by angle $\theta_1$ may be located closer to mixer 42 than the adapters 202 spaced apart by angle $\theta_2$. For example, the closer adapters 202 may be located a distance upstream from mixer 42 that is about equal to the axial distance d between adapters 202. Angles $\theta_1$ and $\theta_2$ may be selected to promote distribution of injected reductant substantially equally throughout an inlet of mixer 42. In the disclosed example, BO may be about equal to one-half of $\theta_2$, and $\theta_2$ may be about 70-90°.

Further, it may be possible that one or more of adapters 202 is tilted to allow for reductant injections axially downstream toward and/or into mixer 42 (i.e., as opposed to perfectly radially inward). In particular, axis 204 of adapters 202 may be tilted along the flow direction of exhaust through passage 26 (see FIG. 2), such that more inward portions of corresponding injectors 34 are closer to mixer 42 than more outward portions. This configuration may allow for the injected reductant to be aimed at particular geometry within the downstream mixer 42, and for a distance from injection initiation to injection impact to be greater than a diameter of exhaust passage 26. This greater injection distance may promote mixing and dispersion of the injected reductant.

Figure 4:
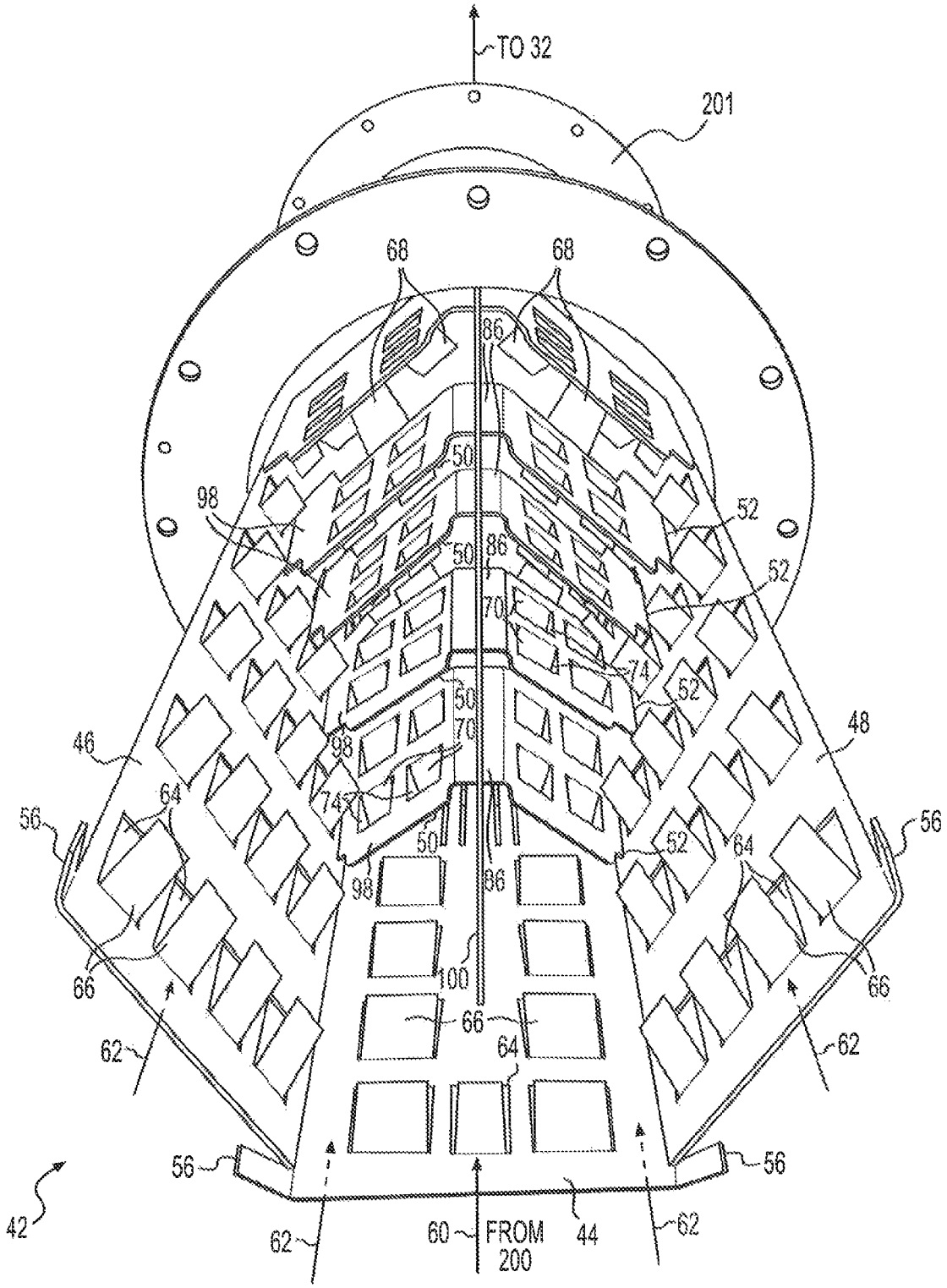
FIG. 4 is an isometric illustration of the mixer of FIG. 3.

As shown in FIGS. 3 and 4, mixer 42 may be an assembly of multiple different components. In particular, mixer 42 may include an impingement floor 44 located opposite reductant injectors 34 (referring to FIG. 3) within exhaust passage 26, a first side wall 46 connected along one lengthwise edge of impingement floor 44, a second side wall 48 connected along an opposing lengthwise edge of impingement floor 44, and a plurality of shelves 50 connected transversely between first and second side walls 46, 48. Impingement floor 44, first side wall 46, and second side wall 48 may form a three-sided enclosure configured to receive injections of reductant at a leading end, upstream of shelves 50.

Impingement floor 44, first side wall 46, and second side wall 48 may each be generally flat, plate-like components that are welded to each other along their intersections. Walls 46 and 48 may be angled outward away from impingement floor 44, such that an obtuse interior angle β (see FIG. 3) is formed. In one example, angle β may be about 90-120°. This configuration may increase an interior volume of mixer 42 that accommodates large reductant injections having wide spray patterns.

Shelves 50, unlike impingement floor 44 and walls 46, 48, may not be plate-like. Instead, shelves 50 may have an inverted, generally V-shape, wherein a vertex 86 of each shelf 50 is oriented away from impingement floor 44. In this configuration, two faces 98 of each shelf 50 may be generally perpendicular relative to injection directions of the closest pair of reductant injectors 34. This arrangement, combined with the flow direction of exhaust through passage 26 may facilitate efficient mixing of reductant with exhaust. It is contemplated that, instead of each shelf 50 having a single-piece inverted V-configuration, two different shelf pieces may alternatively be connected between walls 46, 48 at each shelf 50, and angled relative to each other to form the inverted V-shape, if desired.

Shelves 50 may be spaced apart from each other in the injection direction, and each include one or more side-located tabs 52 (see FIG. 4) that engage and are welded to corresponding slots (not shown) within first and second side walls 46, 48. Each of impingement floor 44, first side wall 46, and second side wall 48 may similarly include at least one tab 56 configured to engage and be welded to a cylindrical inner surface of exhaust passage 26 (i.e., of segment 201). Accordingly, mixer 42 and segment 201 of exhaust passage 26 may be formed into an integral component also known as a mixing module 43 (see FIG. 1).

The location and planar geometry of impingement floor 44, first side wall 46, and second side wall 48, when placed inside the cylindrical geometry of exhaust passage 26, may form a central flow path 60 between walls 46, 48, and a plurality of separated peripheral flow paths 62 outside of walls 46, 48. And because of the location of mixer 42 relative to reductant injectors 34, the reductant injected by injectors 34 may flow into mixer 42 via central flow path 60, but be blocked from peripheral flow paths 62 by impingement floor 44, first side wall 46, and second side wall 48. This may help to inhibit the injected reductant from splashing against the relatively cooler interior surface of exhaust passage 26 and depositing thereon. In addition, because impingement floor 44, first side wall 46, and second side wall 48 may be held away from the inner surface of exhaust passage 26 by tabs 56, these components may not form obstructions at the inner surface that tend to accumulate reductant.

Impingement floor 44 may be an elongated component that extends further upstream away from shelves 50 than first and second side walls 46, 48. This extension may help to ensure that the reductant is not injected completely across exhaust passage 26 and onto the opposing cylindrical surface of exhaust passage 26. Because of the locations and orientations of first and second walls 46, 48 (i.e., because these walls may not be in the direct injection path of the reductant), they may not need to be as long as impingement floor 44, and their shorter lengths may help to reduce a cost and weight of mixer 42. In addition, the absence of first and second side walls 46, 48 (and the associated increase in flow area) at the injection location, may help to slow a velocity of exhaust gas passing through this vicinity. The slower velocity may allow for greater injection penetration and subsequent mixing.

Each of impingement floor 44, first side wall 46, and second side wall 48 may include a plurality of openings 64 fluidly connecting peripheral flow paths 62 with central passage 60, and a converging fin 66 associated with each opening 64. Converging fins 66 may take a variety of forms, but all may generally function to enhance or divert flow inward toward a center of flow path 60. In the disclosed example, converging fins 66 are connected at a leading end of each opening 64 and extend inward into central flow path 60 at a trailing end to enhance inward flow. In another example (not shown), converging fins 66 may be connected at the trailing end and extend outward into peripheral flow path 62 at the leading end to divert the flow inward. In either configuration, exhaust may travel from peripheral flow paths 62 through openings 64 and into central flow path 60. And converging fins 66 may function to keep injected reductant away from the internal cylindrical walls of exhaust passage 26.

Shelves 50 may each include a plurality of vanes 68 and a plurality of mixing fins 70. In particular, vanes 68 may extend from a trailing edge of each shelf 50, and be angled relative to the flow direction of gas through mixer 42 to interrupt and restrict, and thereby increase a velocity of, the exhaust flow. For example, vanes 68 may be angled at about ±40-50° (e.g., about ±45°) relative to the flow direction of exhaust gas in passage 26. A greater angle may increase flow restrictions too much, while a lesser angle may reduce mixing. In one embodiment, vanes 68 may extend alternatingly toward impingement floor 44 and away from impingement floor 44 across the trailing edge of shelves 50. In particular, the outermost vanes 68 and one or more center vanes 68 of each shelf 50 may extend upward toward injectors 34 (i.e., away from impingement floor 44), while vanes 68 located between the outermost and center vanes 68 may extend downward toward impingement floor 44 (or vice versa). In addition, vanes 68 of one shelf 50 may overlap somewhat with vanes 68 of an immediately adjacent shelf. This configuration may result in a turbulent (i.e., non-swirling, non-laminar, and non-recirculating) mixing of the reductant with exhaust gas. In addition, vanes 68 may form impingement surfaces for the injected reductant, causing collisions that function to break up reductant molecules.

In contrast to vanes 68, mixing fins 70 may be located within faces 98 of shelves 50, at an end of associated openings 74. In general, there may be fewer vanes 68 than mixing fins 70 within a given shelf 50, and mixing fins 70 may be angled less steeply. An exemplary shelf 50 may have eight mixing fins 70 and five vanes 68, with mixing fins 70 angled at about ±20-30° (e.g., about ±25°) relative to the exhaust flow direction through mixer 42.

A central divider 100 may be included within mixer 42, in some embodiments, to help center exhaust flow through left and right halves of mixer 42. In particular, central divider 100 may extend generally perpendicularly away from impingement floor 44 and pass through vertices 86 of shelves 50. A plurality of diverging fins 102 may protrude from central divider 100 toward each of first and second side walls 46, 48. For example, one diverging fin 102 may extend toward each of first and second side walls 46, 48, between each shelf 50. These diverging fins 102 may help to divert the exhaust flow away from a center of mixer 42 and towards a center of each leg of shelf 50.

Shelves 50 of mixer 42 may each be different. For example, each shelf 50 may have a different length and, thus, terminate at different axial locations to form steps within mixer 42. In particular, the shelf 50 closest to impingement floor 44 may be longest and extend a greater distance upstream than any of the other shelves 50. And likewise, the shelf 50 furthest away from impingement floor may be shortest and extend a shorter distance upstream than any of the other shelves 50. The intermediate shelves 50 may have lengths incrementally shorter than the closest shelf 50 and longer than the furthest shelf 50, based on their proximity to impingement floor 44. This arrangement of shelves 50 may help provide for substantially equal distribution of reductant into the spaces between shelves 50. That is, a greater amount of reductant may be entrained in the exhaust furthest away from impingement floor 44 due to the injection initiation location and spray direction, and the shorter lengths of shelves 50 at this location may provide a greater axial distance and time for the reductant to disperse before entering the spaces between the shelves 50. It is contemplated that shelves 50 may all terminate at the same axial location at an outlet of mixer 42, or that shelves 50 may terminate at different axial locations in a manner similar to the inlet of mixer 42. In embodiments where shelves 50 terminate at different axial locations, mixer 42 may be axially symmetric (with respect to shelf length) or asymmetric, as desired.

In the disclosed embodiment, all components of mixer 42 may be separately fabricated from flat stainless steel sheet stock through a stamping procedure. Specifically, the outlines of each component and each feature of each component may be stamped, and then the separate features bent and the components welded together, as required. It is contemplated, however, that one more of the components described above could alternatively be integral components, if desired, and formed through a bending process. For example, impingement floor 44, first side wall 46, and/or second side wall 48, could be bent at their intersections and formed from a single piece of sheet stock.

INDUSTRIAL APPLICABILITY

The dosing system of the present disclosure may be applicable to any engine application, where efficient, even, and thorough mixing of reductant and exhaust is desired. The disclosed dosing system may be particularly applicable to diesel engine applications for use in reducing $NO_x$ at downstream catalysts.

Several advantages may be associated with the disclosed dosing system. For example, the disclosed dosing system implementing axially staggered, axially tilted, and annularly spaced injectors, together with the disclosed mixer, may inhibit injected reductant from spraying against a cool wall of an associated exhaust duct. This may reduce condensation of the reductant, reduce premature wear of the duct, reduce deposit formation, reduce fowling of the associated injectors, and promote efficient use of the reductant. In addition, the turbulent flows generated in the exhaust by the disclosed mixer may improve reductant/exhaust mixing.

It will be apparent to those skilled in the art that various modifications and variations can be made to the dosing system of the present disclosure without departing from the scope of the disclosure. Other embodiments will be apparent to those skilled in the art from consideration of the specification and practice of the dosing system disclosed herein. It is intended that the specification and examples be considered as exemplary only, with a true scope of the disclosure being indicated by the following claims and their equivalents.

What is claimed is:

1. A mixer, comprising:

an impingement floor located within an intended fluid injection path and generally parallel with a flow direction through the mixer;

a first side wall that is flat and connected along a lengthwise edge of the impingement floor;

a second side wall that is flat and connected along an opposing lengthwise edge of the impingement floor; and a plurality of shelves extending between the first and second side walls, the plurality of shelves each having a plurality of vanes that promote mixing of an injected fluid, wherein each of the plurality of shelves extends a different distance upstream opposite the flow direction;

wherein each of the plurality of shelves is generally V-shaped and arranged such that a vertex formed by the V-shape is oriented away from the impingement floor and the V-shape opens toward the impingement floor; and wherein the first side wall and the second side wall form a first obtuse angle and a second obtuse angle with the impingement floor, respectively, and each of the plurality of shelves extends between and is connected to each of the first side wall and the second side wall.

2. The mixer of claim 1, wherein the plurality of shelves closer to the impingement floor extend a greater distance upstream than the plurality of shelves further from the impingement floor.

3. The mixer of claim 1, wherein:

the mixer further includes:

a center divider extending from the impingement floor through the vertex of each of the plurality of shelves; and a plurality of diverging fins formed at a trailing edge of the center divider that protrude in opposing directions toward the first and second side walls.

4. The mixer of claim 1, wherein the plurality of shelves are spaced apart at generally equal distances from the impingement floor.

5. The mixer of claim 1, wherein each of the impingement floor, first side wall, and second side wall have a plurality of converging vanes that promote inward movement of the injected fluid.

6. The mixer of claim 5, further including a plurality of mixing fins located at an end of each of the plurality of shelves.

7. The mixer of claim 1, further including a cylindrical passage segment housing the impingement floor and the first and second side walls, wherein:

a central flow path is formed between the first and second side walls; and peripheral flow paths are formed between the cylindrical passage segment and each of the impingement floor, the first side wall, and the second side wall.

* * * * *